US006213622B1

(12) United States Patent
Shimada et al.

(10) Patent No.: US 6,213,622 B1
(45) Date of Patent: Apr. 10, 2001

(54) STEP LIGHTING FOR THEATERS AND THE LIKE

(75) Inventors: Takehiko Shimada, Rolling Hills Estates; William F. Ryczek, Glendora, both of CA (US)

(73) Assignee: Shimada Enterprises, Inc., Santa Fe Springs, CA (US)

( * ) Notice: Subject to any disclaimer, the term of this patent is extended or adjusted under 35 U.S.C. 154(b) by 0 days.

(21) Appl. No.: 09/235,651

(22) Filed: Jan. 22, 1999

Related U.S. Application Data

(63) Continuation-in-part of application No. 09/036,286, filed on Mar. 6, 1998, now Pat. No. 6,145,996.

(51) Int. Cl.[7] ..... F21S 8/00
(52) U.S. Cl. ..... 362/146; 362/240; 362/800
(58) Field of Search ..... 362/145, 146, 362/127, 131, 240, 800

(56) References Cited

U.S. PATENT DOCUMENTS

| | | | | |
|---|---|---|---|---|
| 934,122 | * | 9/1909 | Woodman | 362/146 |
| 1,420,059 | | 6/1922 | Roth . | |
| 1,488,888 | | 4/1924 | Lewensohn . | |
| 1,575,690 | | 3/1926 | Kausal . | |
| 1,879,273 | | 9/1932 | Irminger . | |
| 2,310,593 | | 2/1943 | Orlicki . | |
| 2,390,665 | * | 12/1945 | Putt | 362/146 |
| 2,635,681 | | 4/1953 | Hiltman et al. . | |
| 2,766,372 | | 10/1956 | Albris . | |
| 2,865,438 | | 12/1958 | Machielse et al. . | |
| 3,057,991 | | 10/1962 | Grenadier . | |
| 3,131,871 | | 5/1964 | Foulds . | |
| 3,740,541 | | 6/1973 | Conradt . | |
| 3,745,327 | | 7/1973 | Lowery et al. . | |
| 3,753,217 | | 8/1973 | Willfurth . | |
| 3,885,144 | * | 5/1975 | Lewis et al. | 362/146 |
| 4,161,769 | | 7/1979 | Elliott . | |
| 4,625,266 | * | 11/1986 | Winter | 362/146 |
| 5,222,799 | * | 6/1993 | Sears et al. | 362/146 |
| 5,430,627 | * | 7/1995 | Nagano | 362/146 |
| 5,749,643 | * | 5/1998 | Porter et al. | 362/146 |
| 5,785,414 | * | 7/1998 | Baker et al. | 362/240 |
| 5,918,962 | * | 7/1999 | Nagano | 362/146 |

* cited by examiner

*Primary Examiner*—Sandra O'Shea
*Assistant Examiner*—Peggy A Neils
(74) *Attorney, Agent, or Firm*—Lyon & Lyon LLP

(57) ABSTRACT

There is disclosed herein a new form of stair lighting system and fixtures. A wire way is disposed along the sides of a stairway, and lighting fixtures each preferably with a plurality of light sources are suitably affixed to the riser sections of the stairway on each side of the stairway. Each light fixture preferably is molded as one piece from a suitable plastic and can include preferably three light sources such as LEDs for directing light toward the riser and toward the adjacent stair step. This arrangement is relatively simple and facilitates installation of suitable stairway lighting. Also disclosed is a new form of lighting fixture for use underneath the arm rest of a theater chair for illuminating adjacent stairs and risers.

19 Claims, 8 Drawing Sheets

STEP LIGHTING FOR THEATERS AND THE LIKE

This application is a continuation-in-part of application Ser. No. 09/036,286 filed Mar. 6, 1998 for a Theater Lighting System now U.S. Pat. No. 6,145,996.

The present invention relates to lighting systems, and more particularly to step lighting systems for illuminating stairway steps and aisles in theaters and the like for providing suitable illumination without creating obtrusive lighting.

BACKGROUND OF THE INVENTION

Various forms of lighting systems have been devised for theaters for lighting aisles, stairs and the like. Typically, low voltage string lighting systems are used which incorporate an incandescent or LED lighting strip having a number of spaced light bulbs or light sources.

In the case of steps and stairs, typically one or more stair "nosing" strips are provided at the edge or "nose" of each stair. For a number of years these devices have been provided for illuminating either upwardly from the forward edge of the stair or downwardly onto the riser and/or the next lower step so that the edge of each stair is illuminated and visible whether one is walking up or down the stairway. Lighting systems of this nature are particularly desirable and useful in environments where the lighting level is low, such as in motion picture theaters and the like. With the advent of "stadium" type seating in motion picture theaters, stairs are more common in these theaters today, thereby creating a further need for suitable stair edge nose lighting.

Various forms of extrusions either of metal, such as aluminum, vinyl or plastic have been devised for holding a string of spaced light sources on a stair nose for illumination either upwardly or downwardly, or both. Typical lighting systems of this nature for illuminating both upwardly and downwardly involve either an extrusion for containing two sets of lights, or plural extrusions which are joined together with each holding a set of lights, for providing the upward and downward lighting. Generally, these lighting systems are relatively complicated because of the dual lighting systems involved.

U.S. Pat. No. 5,810,468 assigned to the assignee of the present application, discloses an improved step lighting system for the stair edge or nose, and wherein a single lighting string in combination with an extrusion provides both the upward and downward illumination. In one embodiment, a combined lens and reflector is provided to allow light from a string of lights to be reflected upwardly and light from that string to impinge through the lens downwardly toward the riser and/or step below. In another embodiment, the extrusion houses a prism-type lens assembly for directing light both upwardly and downwardly. In another embodiment, the extrusion houses a dual reflector system for reflecting light from a light string both upwardly and downwardly. In a still further embodiment, the extension houses a lens and prism-type lens assembly for directing light both upwardly and downwardly but with improved downward illumination. In each instance, the extrusion may include slots at either end thereof for receiving the ends of carpet, such as carpet on the step and carpet on the riser.

Although the foregoing step lighting systems provide suitable lighting, they involve providing an extrusion for each stair edge or nose, as well as extrusions for providing wire ways to the various strings of light.

Application Serial No. 09/036,289 discloses several alternative and/or additional lighting systems for theater stairs, aisles, floors and the like, and which both provide suitable lighting for patrons walking along these areas and without generating light that may be obtrusive to those sitting in seats, viewing a motion picture, or the like, but further provide relatively simple lighting systems as compared to stair edge or nose installations.

In that application one embodiment comprises a strip lighting fixture having a series of lamps or LEDs adjacent a reflector located underneath the arm rest of a theater chair (or under an outer edge of the chair) to illuminate the adjacent steps or aisle. Another embodiment involves a small vertical strip light on one or both sides of the riser of each step of a stair. Other embodiments involve a hand rail having a series of lamps disposed therein or thereon, and strip lighting for use along an aisle or the like. The lamps in each embodiment preferably are LEDs.

Other examples of lighting system for use in theaters and other locations are found in patents which disclose lighting associated with theater chairs such as Kasual U.S. Pat. No. 1,575,690, Hiltman U.S. Pat. No. 2,635,681, Lewensohn U.S. Pat. No. 1,488,888, Irminger U.S. Pat. No. 1,879,273, Roth U.S. Pat. No. 1,420,059 and Machielse U.S. Pat. No. 2,865,438. Examples of stair lighting systems other than commonly used stair nose lighting systems are Willfurth U.S. Pat. No. 3,753,217 and Lowery U.S. Pat. No. 3,745,327. Examples of lights within a hand rail are found in Grenadier U.S. Pat. No. 3,057,991, Foulds U.S. Pat. No. 3,131,871, Elliott U.S.Pat. No. 4,161,769, Albris U.S. Pat. No. 2,766,372, Orlicki U.S. Pat. No. 2,310,593, and Conratt U.S. Pat. No. 3,740,541. None of these provide the relatively simple stair and aisle light systems as disclosed herein.

SUMMARY OF THE INVENTION

The present application provides an improved form of stair lighting device and system over those previously disclosed, and in an exemplary embodiment comprises a simple lighting fixture which can be attached to a wire way of a stair riser on one or both sides of a stair to provide light preferably in three directions, namely toward (1) the riser, (2) the step below, and (3) the wire way on the step below. A light fixture can snap on to or be secured by a screw fastener on the riser wire way, and electrical wires for powering the lamps or LEDs of the fixture run within the wire way. This system eliminates the need for a bull nose on the edge of the stair, and simplifies installation and reduces cost. In an exemplary embodiment, the lighting fixture includes three LEDs which may, for example, be amber colored or any other suitable colors, and a lens or other translucent or clear cover or other color lens can be provided over the LEDs. The housing can be molded as one piece in a configuration to snap into the wire way base located on each side of each step and have an extruded lens.

Additionally, an improved form of lighting fixture for use on or under the arm rest of a theater chair for illuminating the adjacent stairs, aisle and/or floor is disclosed.

Accordingly, it is an object of the present invention to provide an improved lighting system.

An additional object of the present invention is to provide an improved step lighting system.

A further object of the present invention is to provide a single light fixture for holding several lights for directing light onto a stair, riser, aisle, floor or the like.

Another object of this invention is to provide a new form of lighting system for the risers of stairs.

A further object of this invention is to provide a riser lighting system comprising a small vertically mounted light fixture on one or both sides of the riser of each step of a stair.

Another object of the present invention is to provide a new under arm lighting fixture for use under the arm rest of a theater chair for illuminating the adjacent stairs, aisle or floor.

BRIEF DESCRIPTION OF THE DRAWINGS

These and other objects and features of the present invention will become better understood through a consideration of the following description taken in conjunction with the drawings in which.

DETAILED DESCRIPTION

Figure 1A:
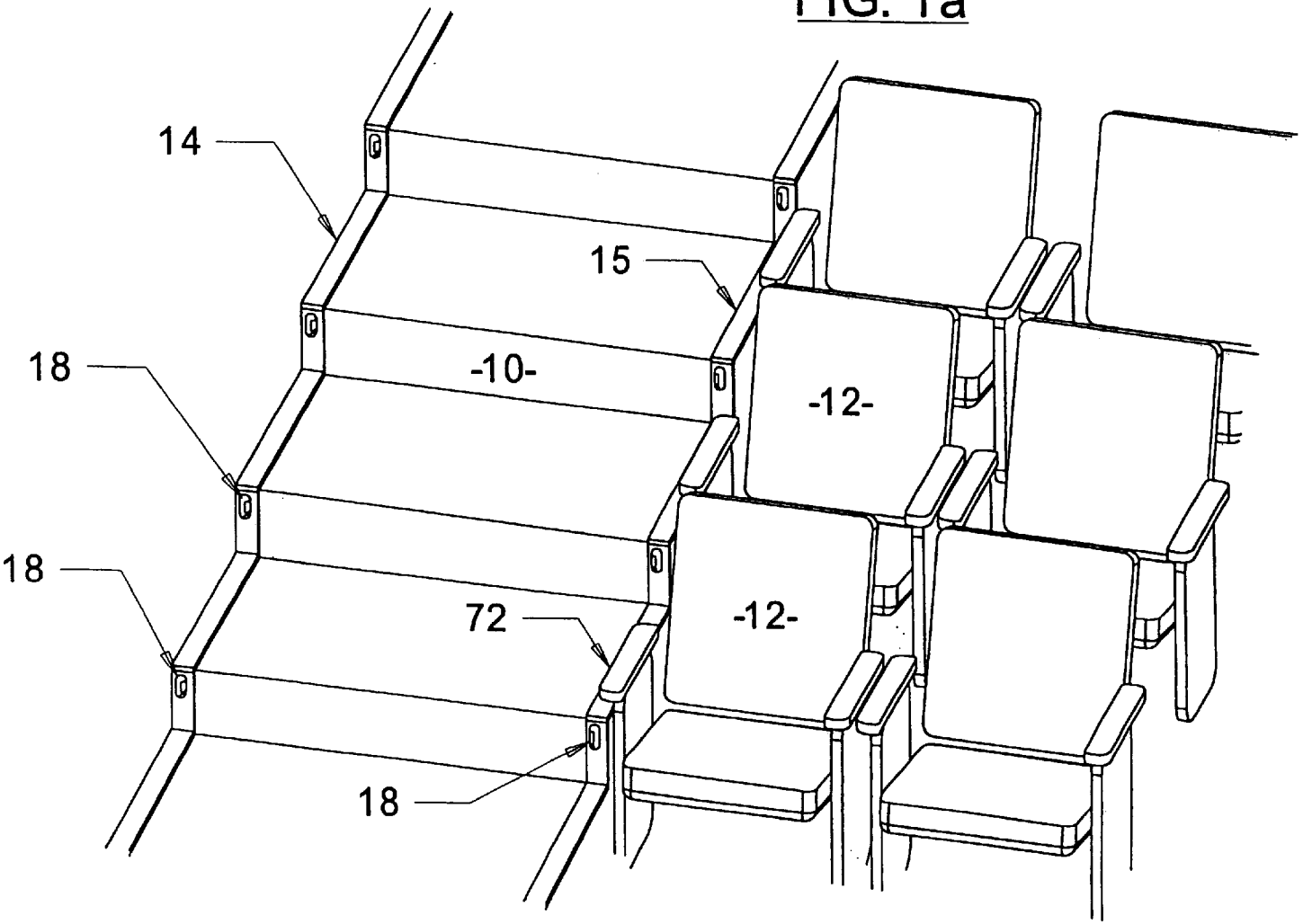
FIG. 1*a* is a perspective view of stairs and adjacent theater seats having riser light fixtures of the present invention.

Turning now to the drawings, and first to FIG. 1*a,* the same is a perspective view of an exemplary theater stairway 10, adjacent theater seats 12, wire ways 14 and 15 on the sides of the stairs 10, and light fixtures 18 attached to the wire ways 14 and 15 according to an exemplary embodiment of the present invention. The wire way 14 and fixture 18 is shown in an enlarged perspective view in FIG. 1*b,* and is shown and illustrated in greater detail in FIGS. 1*c,* and 2 through 4. Also illustrated in FIG. 1*b* is a lens or other form of transparent or translucent cover 18*a* which covers the lights of the fixture 18 as will be further discussed below.

Figure 1B:
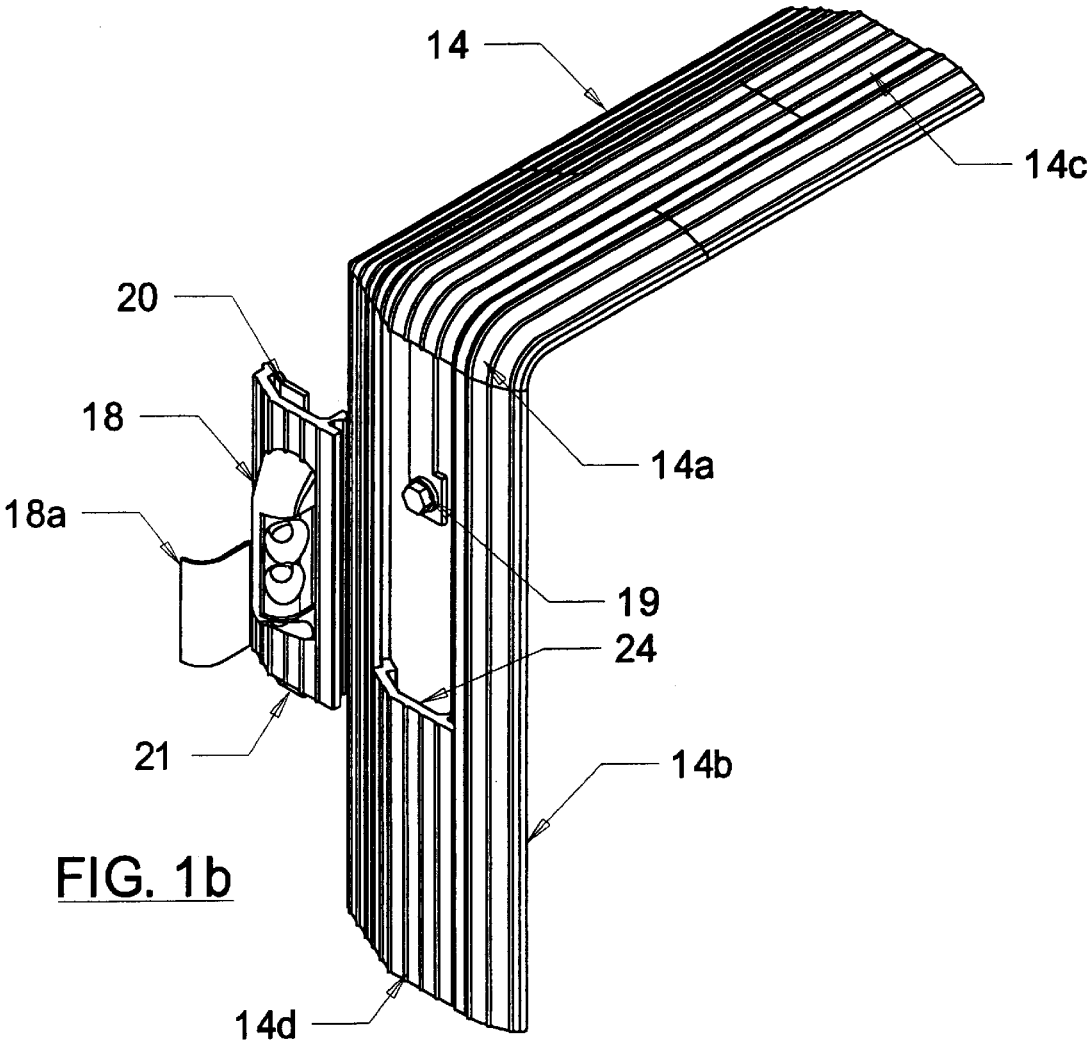
FIG. 1*b* is an exploded view of a portion of a wire way and riser light fixture of the present invention.

It should be noted that in the arrangement shown in FIG. 1*b,* the housing or fixture 18 includes upper and lower lips 20 and 21 which fit into the wire way riser section 14*d* in riser base 14*b* and corner 14*a* to facilitate installation. For example, the lower lip 21 can fit into a groove 24 in the wire way section 14*d* of base 14*b,* and the upper lip 20 can be covered and secured by the corner wire way 14*a* so as to secure the fixture 18 onto the wire way 14. The riser wire way base 14*b* can be secured to the riser of the stairs 10 in any suitable manner, as by a screw fastener 19.

Figure 1C:
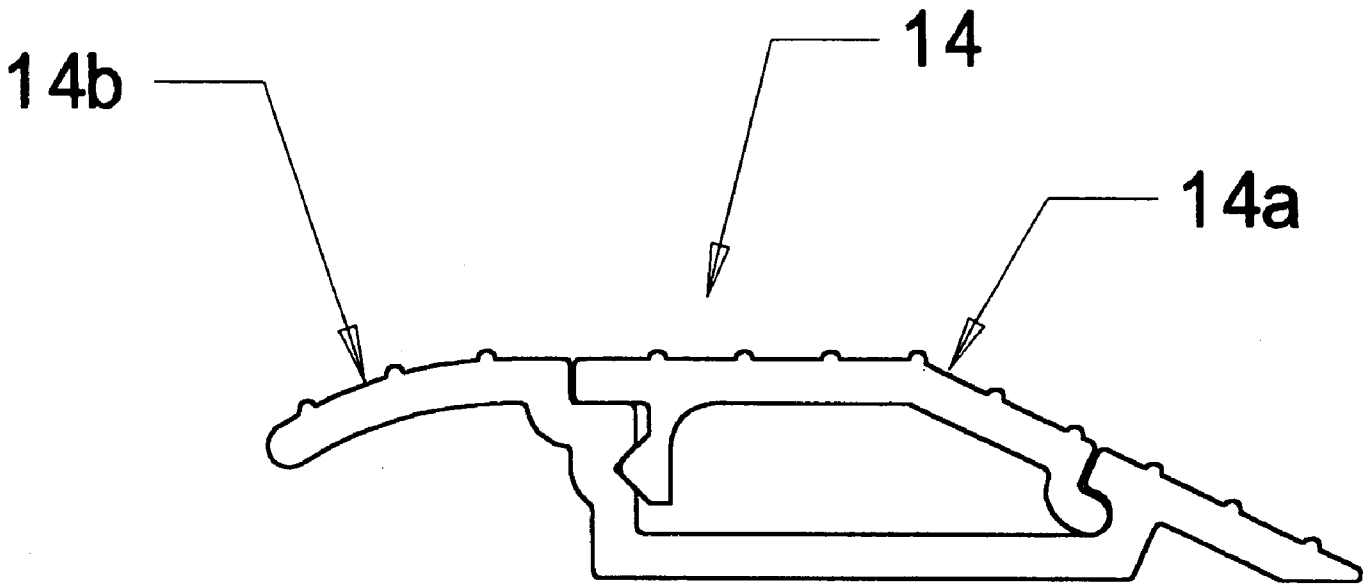
FIG. 1*c* is a cross-sectional view of a wire way.
Figure 2:
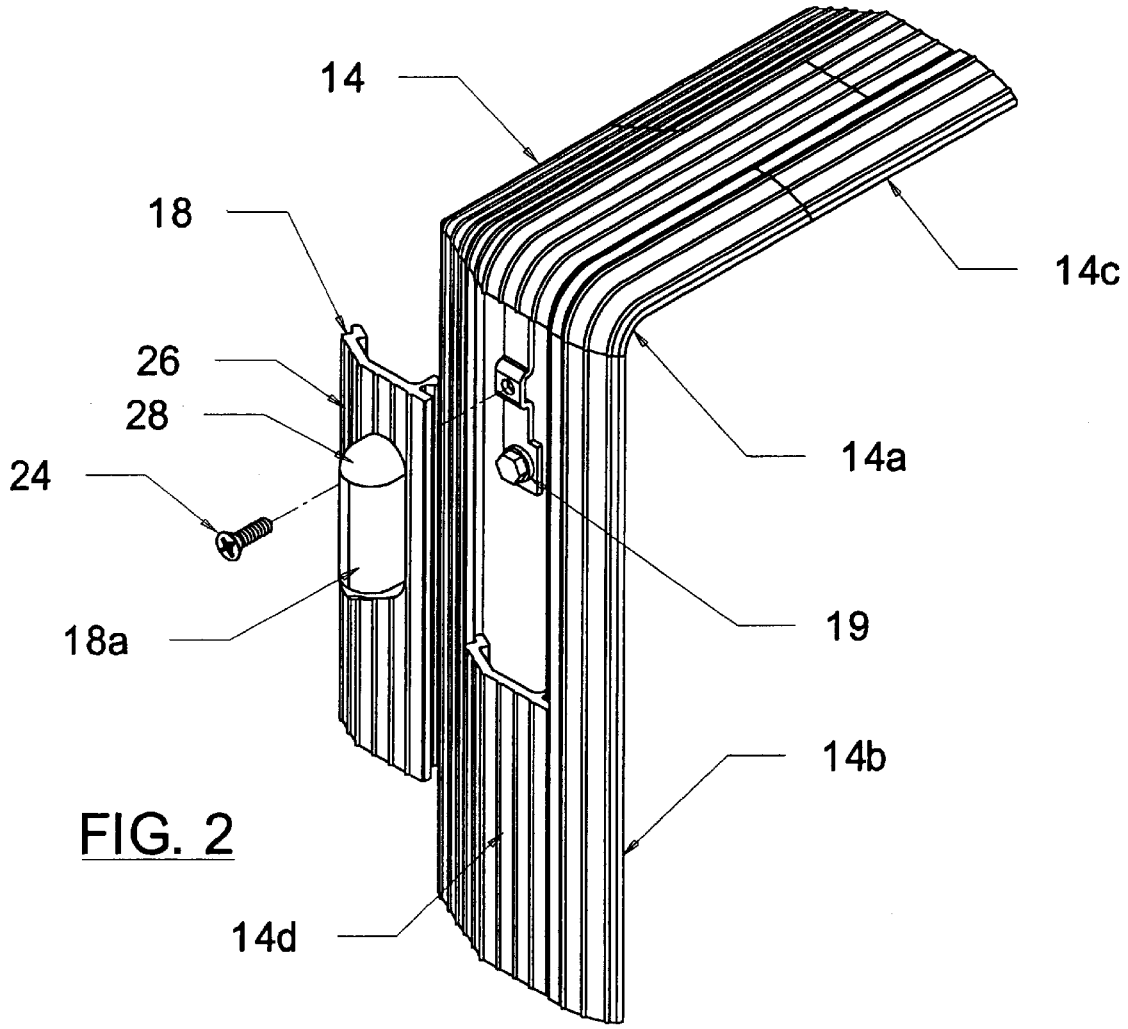
FIG. 2 is a more detailed exploded perspective view of the riser and corner wire way, along with one embodiment of a riser light fixture according to the present invention.

Turning now to FIG. 2, the same is an enlarged perspective view of the wire way 14 and light fixture 18. This embodiment is substantially identical to that shown in FIG. 1, except in this embodiment the light fixture 18 is secured to the wire way 14 by a screw fastener 24 rather than via the snap-in lips 20 and 21. The fixture 18 includes a base section 26 and lamp section 28, all preferably molded in one piece of suitable plastic such as impact grade ABS. The wire way is formed of rigid PVC, and comprises the base sections 14*b* and 14*c*, cover section 14*a* and cover section 14*d*. FIG. 1*c* shows how the cover section 14*d* fits in the base section 14*b*.

Figure 3:
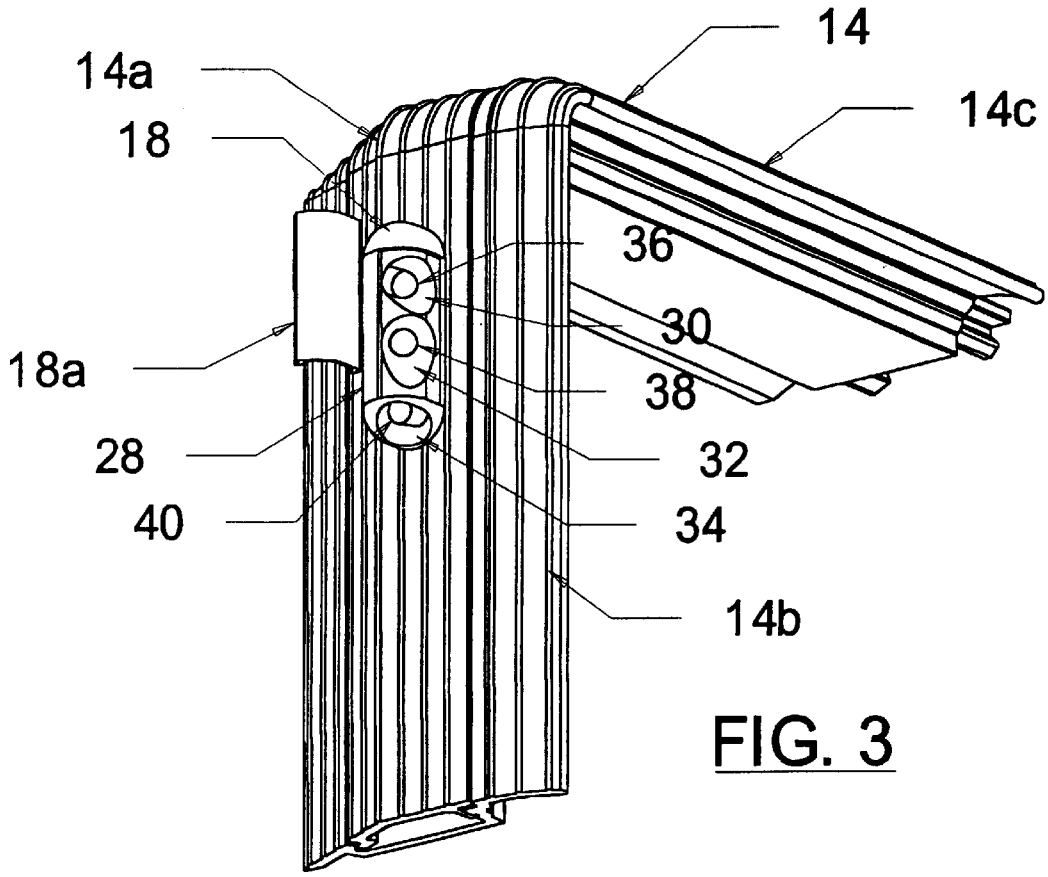
FIG. 3 is a perspective view similar to FIG. 2, but illustrating the lamps or LEDs within the riser light fixture.
Figure 4A:
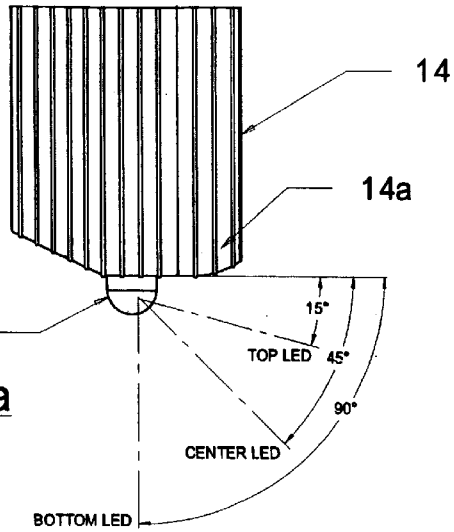
FIGS. 4*a* through 4*c* are illustrations of the riser light fixture of the present invention and further indicate the direction in which the lamps or LEDs thereof are aimed.
Figure 4B:
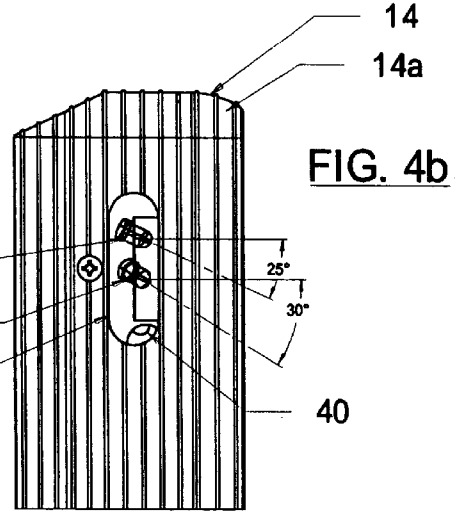
Figure 4C:
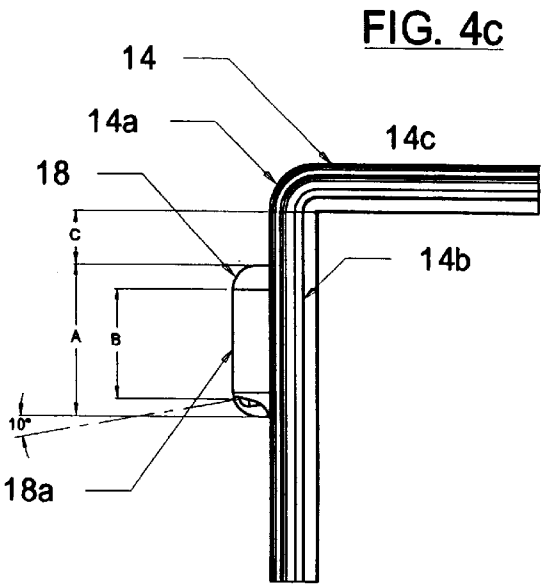

FIG. 3 is an enlarged perspective view similar to that of FIG. 2, but with the lens 18*a* of the fixture 18 removed. The lamp housing 28 includes three cavities 30, 32 and 34 which are molded in a particular manner so that light from each respective LED 36, 38 and 40 is directed in appropriate directions to properly illuminate the stair and riser. FIGS. 4*a* through 4*c* illustrate exemplary angles for the light beams of the respective LEDs, with FIG. 4*a* being a top view, FIG. 4*b* being a front or elevational view, and FIG. 4*c* being a side view looking at the light fixture 18 from the riser. The letters "A" and "B" in FIG. 4*c* illustrate exemplary dimensions for the height of the fixture 18 and length of the lens, "A" indicating the height and "B" indicating the length of the lens. An exemplary number for "A" is 1.65 inches and for "B" 1.19 inches. The letter "C" illustrates an exemplary distance (such as 0.585 inch) from the bottom of the corner piece 14*c* to the top of the fixture 18.

Figure 5C:
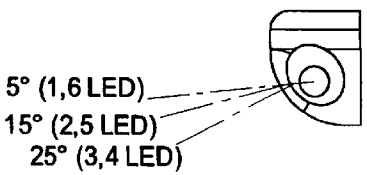
FIGS. 5*a* through 5*c* illustrate an alternative light fixture for use under the arm rest of a theater chair for illuminating the adjacent stairs, aisle or floor.
Figure 5A:
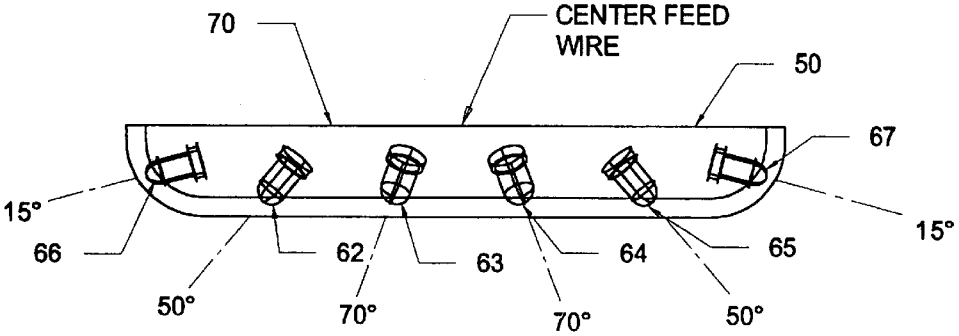
Figure 5B:
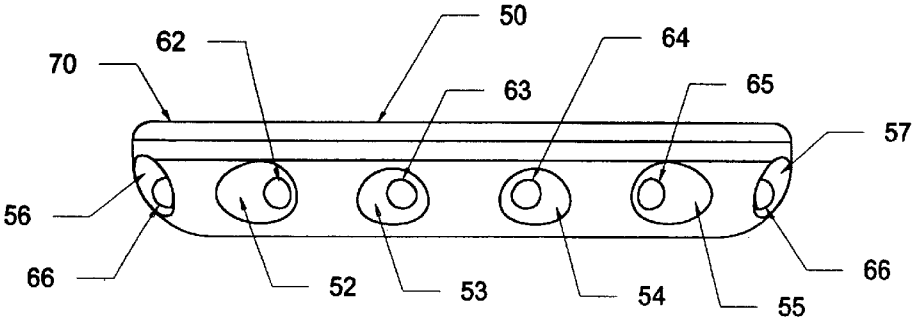
Figure 6:
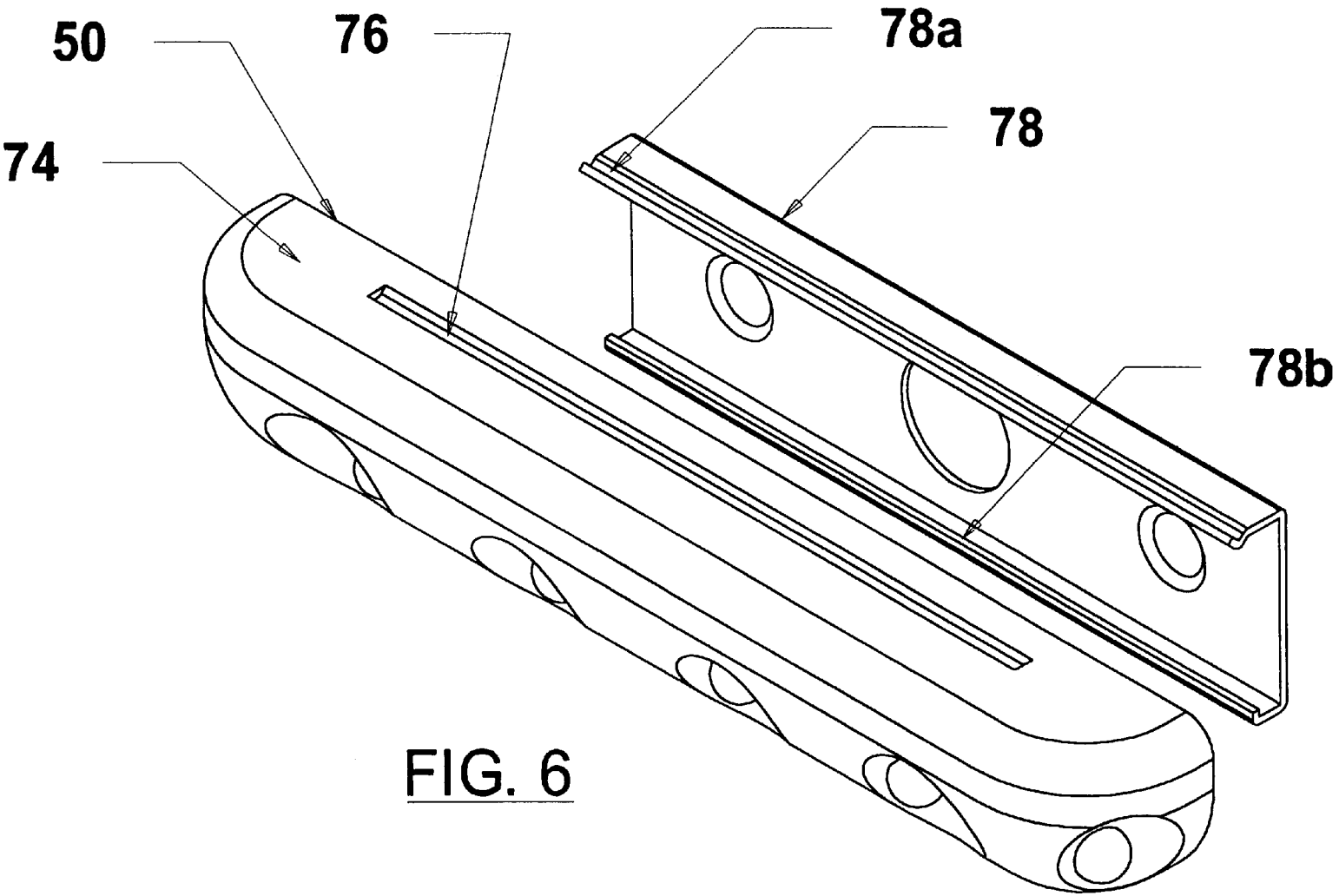
FIG. 6 illustrates a mounting bracket for the fixture of FIG. 5.

FIG. 5 illustrates a new form of lighting fixture for use under the arm rest of a theater chair, and of the general type described in greater detail in said application Ser. No. 09/036,289, the disclosure of which is incorporated herein by reference. This fixture 50 preferably is molded as one piece of plastic and with a plurality of side cavities 52–55 and end cavities 56–57 for respective LEDs 62–65 and 66–67. An upper surface 70 typically is mounted underneath the arm of a theater chair of the type illustrated at 72 in FIG. 1*a* so as to provide lighting toward an adjacent stairway such as stairway 10 in FIG. 1*a*. Alternatively, it can be mounted on the side of the chair below the arm. FIG. 6 shows a suitable mounting arrangement wherein the body 74 of the fixture 50 includes grooves 76 on each side thereof (only one of the grooves being seen in FIG. 6) into which edges 78*a* and 78*b* of a bracket 78 snap to hold the light fixture 50 under the arm rest. The bracket 78 itself is suitably secured underneath the arm rest as by screw fasteners (not shown).

FIG. 5*a* particularly illustrates the direction in which the cavities 52 through 57 are angled so that light from each of the respective LEDs 62 through 67 is directed as desired toward the stairway 10 (FIG. 1) and the risers and steps thereof.

While embodiments of the present invention have been shown and described, various modifications may be made without departing from the scope of the present invention, and all such modifications and equivalents are intended to be covered.

What is claimed is:

1. A step lighting system for providing light on stairs and risers of stairways comprising at least one light fixture to be disposed vertically on a distal edge of a stair riser and comprising an elongate wire way extrusion adapted to be fixed to a lateral distal edge of a stair, an elongate lamp fixture of plastic oriented vertically on a distal edge of a stair rise having at least a clear, colored or translucent area cover for allowing light to pass therethrough, the lamp fixture being adapted to mate with the wire way extrusion, and further including a plurality of cavities for receiving lamps or LEDs, and a plurality of lamps or LEDs disposed in the cavities of the lamp fixture, each respective lamp or LED capable of directing light through the cover in a different direction from an adjacent lamp or LED and toward an adjacent riser and step.

2. A system as in claim 1 wherein the extrusion and fixture have cooperatively mating sections for enabling the fixture to be snapped into and held in the extrusion.

3. A system as in claim 2 wherein the fixture has fingers extending into a cavity in the extrusion.

4. A system as in claim 1 wherein the fixture is secured to the extrusion by a fastener.

5. A system as in claim 1 wherein the lamp or LED fixtures are disposed on each distal edge of a stair riser, and wire ways are connected to the respective ends thereof for providing wires and electrical power to the lamps or LEDs.

6. A step lighting system for providing light on stairs and risers of stairways comprising at least one light fixture to be disposed vertically on a lateral distal edge of a stair riser and comprising an elongate wire way extrusion adapted to be fixed to a lateral distal edge of a stair, an elongate lamp fixture of plastic having an area for allowing light to pass therefrom, the lamp fixture being disposed vertically on a stair riser and adapted to mate with the wire way extrusion, the lamp fixture further including a plurality of cavities for receiving lamps or LEDs, and a plurality of lamps or LEDs disposed in the cavities of the lamp fixture for directing light, each respective lamp or LED directing light in a respective different direction from an adjacent lamp or LED, toward an adjacent riser and step.

7. A system as in claim 6 wherein the extrusion and fixture have cooperatively mating sections for enabling the fixture to be snapped into and held in the extrusion.

8. A system as in claim 7 wherein the fixture has fingers extending into a cavity in the extrusion.

9. A system as in claim 6 wherein the fixture is secured to the extrusion by a fastener.

10. A fixture as in claim 6 including a clear, colored or translucent cover over the cavities.

11. A system as in claim 6 wherein the lamp fixtures are disposed on each distal side of a stair riser, and wire ways are connected to the respective ends thereof for providing wires and electrical power to the lamps or LEDs.

12. A step lighting system for providing light on stairs and risers of stairways comprising a light fixture to be disposed vertically on each lateral distal side of a stair riser and comprising an elongate wire way extrusion adapted to be fixed to each lateral distal side of a stair, an elongate lamp or LED fixture of plastic having at least a clear, colored or translucent cover for allowing light to pass therethrough, the lamp fixture being adapted to mate with the wire way extrusion on each vertical, distal side of the stair riser, and including a plurality of cavities for receiving lamps or LEDs, and a plurality of lamps or LEDs disposed in the cavities of each lamp fixture for directing light through the cover, each lamp or LED directing light in a different direction from an adjacent lamp or LED, toward an adjacent riser and step.

13. A system as in claim 12 wherein the extrusion and fixtures have cooperatively mating sections for enabling each fixture to be snapped into and held in the extrusion.

14. A system as in claim 13 wherein the fixture has fingers extending into a cavity in the extrusion.

15. A systems as in claim 12 wherein the fixture is secured to the extrusion by a fastener.

16. A step lighting system for providing light on a lateral distal edge of stairs and risers of stairways comprising at least one light fixture to be disposed vertically on each lateral distal edge of a stair riser, wherein the system comprises an elongate wire way extrusion adapted to be fixed to each lateral distal edge of a stair, wherein the extrusion has a mating section for enabling a light fixture to be affixed to and held in the extrusion, an elongate riser light fixture of plastic adapted to be fixed in a substantially vertical orientation on each lateral distal edge of a stair riser and having a section adapted to mate with the mating section of the wire way extrusion, wherein the light fixture is connected to an end of the extrusion in order to receive wires and electrical powers from the extrusion, and the light fixture further includes a plurality of cavities for receiving lamps or LEDs, a plurality of lamps or LEDs disposed in the cavities of the riser light fixture, each respective lamp or LEDs oriented to direct light in a different direction from an adjacent lamp or LED and toward an adjacent riser and step through a cover attached to the riser light fixture, and a clear, colored or translucent cover in operable connection with the riser light fixture and covering the plurality of cavities, wherein the cover allows light from the lamps or LEDs to pass therethrough.

17. The system of claim 16 wherein the mating sections of the riser light fixture and the extrusion comprise cooperatively mating sections.

18. The system of claim 16 wherein the mating section of the riser light fixture comprises upper and lower lips and the mating section of the extrusion comprises a cavity designed to accept the lips.

19. The system of claim 16 wherein the mating sections of the riser light fixture and the extrusion are attached by a screw fastener.

* * * * *